United States Patent [19]

Claret et al.

[11] 4,313,576

[45] Feb. 2, 1982

[54] PROCESS AND APPARATUS FOR SIMULTANEOUSLY WINDING SEVERAL YARNS

[75] Inventors: Jean P. Claret, Lyons; Bernard Isoard, Ecully, both of France

[73] Assignee: Rhone-Poulenc-Textile, Paris, France

[21] Appl. No.: 88,417

[22] Filed: Oct. 26, 1979

[30] Foreign Application Priority Data

Oct. 27, 1978 [FR] France ..... 78 31240
Sep. 18, 1979 [FR] France ..... 79 23383

[51] Int. Cl.[3] ..... B65H 54/02; B65H 54/20; B65H 54/34

[52] U.S. Cl. ..... 242/18 PW; 242/35.5 R

[58] Field of Search ..... 242/18 PW, 18 A, 35.5 R, 242/18 R

[56] References Cited

U.S. PATENT DOCUMENTS

| | | | |
|---|---|---|---|
| 2,998,202 | 8/1961 | Keith et al. | 242/18 PW |
| 3,782,648 | 1/1974 | Ito et al. | 242/35.5 R |
| 3,940,075 | 2/1976 | Lenk | 242/18 PW |
| 4,069,983 | 1/1978 | Muramatsu et al. | 242/18 PW |
| 4,085,901 | 4/1978 | Sanders | 242/18 PW X |
| 4,094,471 | 6/1978 | Tschentscher | 242/18 PW |
| 4,136,834 | 1/1979 | Tschentscher | 242/18 PW |

FOREIGN PATENT DOCUMENTS

| | | | |
|---|---|---|---|
| 2831130 | 2/1979 | Fed. Rep. of Germany | 242/18 PW |
| 2378708 | 9/1978 | France | 242/18 PW |

*Primary Examiner*—Stanley H. Gilreath
*Attorney, Agent, or Firm*—Sherman & Shalloway

[57] ABSTRACT

Several yarn packages or yarn reels are simultaneously wound on the same spindle using an improved process and apparatus, especially with regard to the start-up of the winding including the attachment of the yarns to the spindle and the formation of a yarn transfer end. Means are provided for engaging and disengaging the yarns from yarn reciprocating distribution guides which lay down the yarns on the rotating yarn reel. The same means in the form of a guide ramp guides the yarns from a common hooking point attaching the yarns to the spindle and then disengages from the yarns so that the yarns will be contacted for reciprocation over the main winding zone of the yarn reel by the reciprocating distribution guides. Movable positioning guides for each of the yarns are located upstream of the reciprocating distribution guides and adjust the position of the yarns to be wound from the main winding zone to an attachment zone, the latter being used to form a transfer end from which one reel can be connected to another. The movements of the guide ramp and positioning guides are controlled in synchronization with each other. The invention is especially useful in an automatic high speed winding process for continuous synthetic or other chemical yarns and associated apparatus.

16 Claims, 15 Drawing Figures

PROCESS AND APPARATUS FOR SIMULTANEOUSLY WINDING SEVERAL YARNS

BACKGROUND OF THE INVENTION

1. Field of the Invention

This invention relates to a process and apparatus for simultaneously winding several yarns into separate yarn packages or reels on the same spindle and also to a process and apparatus for the formation of a transfer end during the winding process.

In the following description and appended claims the term "yarns" means any filamentary material whether in the form of continuous or discontinuous threads or filaments, or any fiber-like product. However, the yarns dealt with in this application are preferably continuous yarns.

2. Discussion of the Prior Art

One type of winding frame used in the textile industry includes at least one spindle for simultaneously winding several yarns on each spindle by forming separate reels side by side. Each reel is made up of a single yarn or a group of several parallel single yarns, with the group behaving like a single yarn from the viewpoint of its path of travel in the winding operation. For the sake of simplicity, in the following description and appended claims the term "yarn" will also designate both a single yarn and a group of parallel single yarns acting like a single yarn from the viewpoint of its path of travel.

When several separate reels are made on the same spindle, the reels are formed either on a single yarn support (tube) or several supports placed end to end on the spindle, the number of the supports being at most equal to the number of yarns.

The yarns passing through stationary positioning guides are distributed with reciprocating motion along their respective supports by a device provided with reciprocating guides. There are as many positioning guides and reciprocating guides as reels to be made, the number of reels being equal to the number of yarns. Driving of the reels in rotation can be accomplished by a driven spindle or by a pilot roller coming in contact with the outside of the reel or by combination of these two means.

The above type of winding requires the simultaneous depositing of all the yarns on the spindle. French Pat. No. 2,378,708, commonly assigned with the present application, relates to an apparatus which makes it possible to perform this simultaneous depositing of the yarns. The apparatus includes a device for selecting yarns, the selecting device being made up of a guide ramp extending ahead of and parallel to the movement of the reciprocating guides, the ramp being cut by straightline escape slots at a rate of one slot per yarn site. During the throwing or depositing of the yarns, the yarns pass through different positioning guides, are then grouped at the level of a handling gun and hooked at the end of the spindle by the gun. The yarns slide along the ramp, because each of them, under the influence of recall forces, has a tendency to move along the perpendicular between the positioning guide and spindle. By resting on the ramp, the yarns are disengaged from the reciprocating guides. The yarns being grouped on the spindle at the time of hooking, but coming from separate positioning guides, are at the level of the ramp with different inclinations. The orientation of each escape slot being a function of the inclination of the yarn to be selected at the level of its reel size, the yarns, one after the other, escape from the ramp by their respective slot and fall into the area traversed by their reciprocating guide which grabs them. A device for forming transfer ends, for example by a swinging pin, can be mounted on each reel site.

While the apparatus of this French patent has met with substantial success it is quite complex and requires a high degree of machining precision making it difficult to manufacture and expensive.

SUMMARY OF THE INVENTION

This invention provides an improved and simplified process and apparatus for forming several yarn reels on the same spindle, and optionally also provides in a specific embodiment, apparatus and a process for the formation of a transfer end at the beginning of each reel.

The objectives of the invention are accomplished by an improvement in the process for simultaneously winding several yarns on a single spindle whereby each yarn forms a separate reel. Each of the several yarns, travelling in a distinctly defined path, passes into or through a positioning guide and then into contact with a reciprocating distribution guide from which the yarns are attached to the spindle and deposited on the several yarn support tubes carried on the spindle. The reciprocating distribution guide coupled with the rotation of the support tubes and then the reels themselves causes the yarns to be uniformly would in a back and forth path of travel in a winding zone on each support tube to form the yarn reels. The improvement in the yarn winding process for attaching the yarns to the spindle and beginning winding is accomplished by the steps of at least passing the yarns through their respective positioning guide, then substantially simultaneously attaching the yarns to an end of the spindle; applying a force to each of the yarns to put each of the yarns out of contact of their reciprocating distributing guide since the yarns move in a direction approximately parallel to the axis of the spindle whereby the yarns, under the influence of recall forces tend to position themselves on their respective winding zones on their yarn support tubes at right angles to their respective positioning guides, and then removing the force from each of the yarns whereby each of the yarns changes its path of travel in a direction to engage with its respective reciprocating distribution guide.

The present invention also provides a process for simultaneously depositing yarns on the support tubes on a spindle for formation of reels with the formation of transfer ends at the beginning of each reel, each transfer end being located in a zone of attachment outside the zone of the main winding of each reel. In this case, after engagement of the yarn by the reciprocating guides, the process further comprises the following steps:

moving the positioning guides to position over the attachment zone and applying forces to the yarns to remove the yarns from the reciprocating guides;

forming the transfer ends at right angles to the positioning guides; and, removing the forces from the yarns and returning the positioning guides to their original position, when the transfer ends are finished.

In the present invention a guide ramp is used to apply the forces to the yarns to move them out of engagement with the reciprocating guide members. Displacement of the guide ramp out of contact with the yarns then removes the forces and allows the yarns to move back towards their previous position for reengagement with their associated reciprocating distribution guide.

Movement of the positioning guide to a level over the attachment zone may be made either before or after removal of the yarns from the reciprocating guides. The yarns are removed from the reciprocating guides, when changes in tension cause the striking of the guides against the yarn and creates a risk of having harmful effects on the process or the yarn, for example, risks of breaking and deterioration on the delivery rolls placed upstream from the winding frame.

The present invention also provides apparatus for completely automatically performing the process.

The apparatus for simultaneously depositing several yarns to be wound in separate reels on the same spindle of a winding frame, includes a spindle provided with means for attaching the yarns to one of its ends, means for bringing the yarns during the winding by separate paths, into contact with a positioning guide and then, during winding, into a reciprocating distribution guide and is characterized by a guide ramp extending along the zone traversed by the reciprocating guides, the ramp being able to occupy two positions: an "active" position where the yarns rest on it in the section between the positioning guide and spindle and are disengaged from the reciprocating guides, and an "inoperative" position where the yarns are out of contact with the ramp and are placed in contact with the reciprocating guides; and a temporary yarn holding pin for positioning and maintaining the yarns being attached to the spindle, the pin being located at the level of the end of the spindle where the yarns are attached to the spindle.

The attachment occurs when the yarns escape from the pin. The pin can be retractable or stationary. In the former case, retraction causes escape of the yarns and their attachment on the spindle. In the latter case, the movement of the ramp going from the "withdrawn" position to the "active" position is used to cause the escape of the yarns.

When it is desired to form a transfer end at the beginning of a reel, the apparatus further includes: means for movably mounting the positioning guides between the zone corresponding to the main winding zone and an attachment zone corresponding to the transfer end and means for drawing, control and synchronization of the movements of the guide ramp, positioning guides and optionally the temporary holding pin.

According to a preferred embodiment of the apparatus, the positioning guides are integrally connected with a rod capable of sliding movement in a direction approximately parallel to the axis of the spindle, the rod being moved by a crank-connecting rod system. According to a simple assembly, the sliding rod is connected directly to the rod head. Advantageously, a pneumatic or hydraulic jack (or equivalent device) is incorporated in the crank-connecting rod system for better control of the movement of the positioning guides in the attachment zone. The movement of the jack combines with that of the crank-connecting rod system to increase the speed of movement of the positioning guides whereby a transfer end can be made with more or less tight coils.

According to a particularly advantageous embodiment, there is provided, for at least one yarn, and preferably for all yarns, an intertwining nozzle placed approximately at the site of the corresponding positioning guide on the means for mounting the several reciprocating guides associated with each of the yarns and yarn support tubes.

In practice, when a transfer end is made, the yarn constituting the end should exhibit a good cohesion and be very clean. This avoids risks of strand by strand tangling of multifilament yarns from one coil to the next, which would impede the normal unwinding of the transfer end.

In the winding process, during the formation of the transfer end the yarn is most roughly handled and the risk of opening of the strands of multifilament yarn is greatest, despite the cohesion that can be imparted by means such as oiling. To moderate this drawback, the yarn is intertwined at least slightly before winding by the intertwining nozzle supplied with an air jet.

The intertwining nozzle can perform the function of the positioning guide, after possible conversions, in particular at its outlet. In this case, the regular positioning guide can be eliminated. It is also possible to retain the positioning guide, modified or not, the nozzle being mounted upstream and adjacent to the latter.

All known types of intertwining nozzles can be used and can function during the entire winding period or preferably only during the phase of forming the transfer end.

Drive means are provided for starting and stopping the intertwining nozzles. These means and the means for control and synchronization of the movements of the ramp, the positioning guides and retractable pin comprises a program, which preferably can be integrated in a larger program of winding and bobbin-changing that is entirely automatic.

BRIEF DESCRIPTION OF THE DRAWINGS

The invention will be better understood from the following illustrative and non-limiting examples and accompanying drawings in which.

DETAILED DESCRIPTION OF THE DRAWINGS AND SPECIFIC EMBODIMENTS

Figure 1:
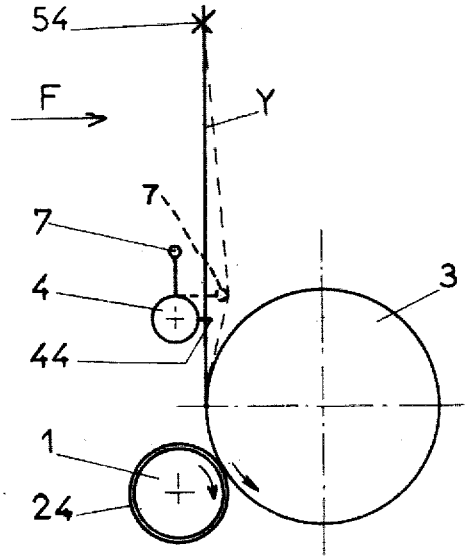
FIG. 1 is a schematic end view of a winding frame equipped with one embodiment of a device according to the invention.
Figure 2:
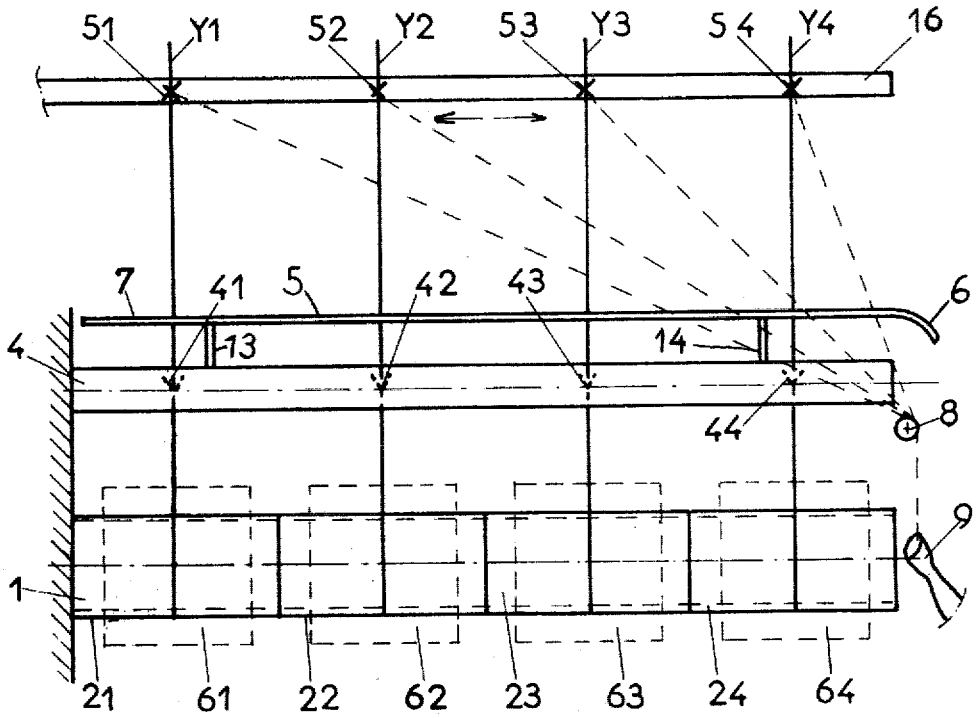
FIG. 2 is a side elevation view in the direction of arrow F of FIG. 1.
Figure 3:
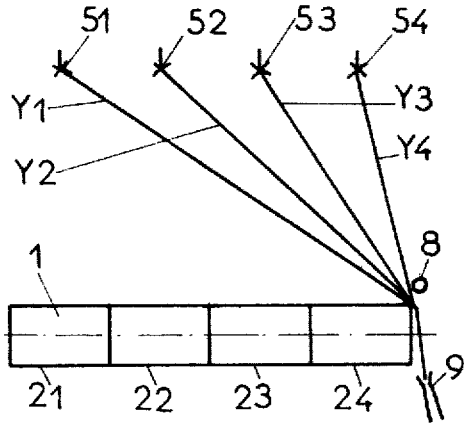
FIGS. 3 to 9 illustrate diagrammatically the various phases of the process according to the invention.
Figure 6:
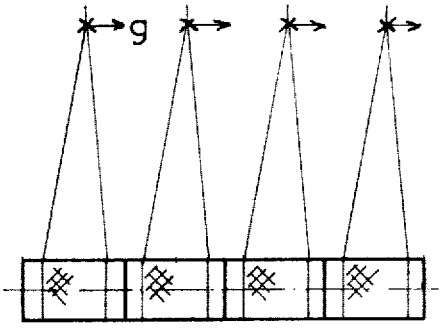
Figure 4:
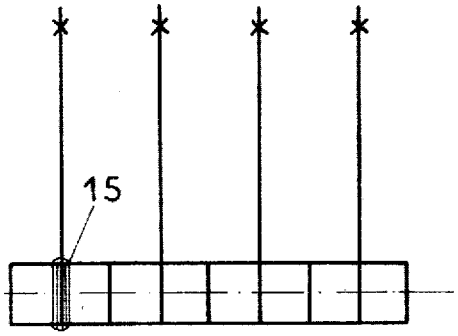
Figure 7:
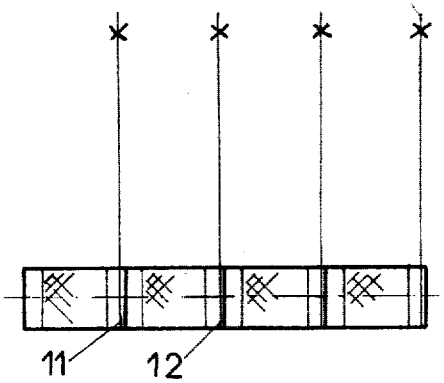
Figure 5:
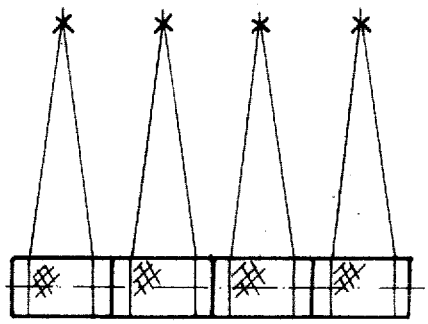
Figure 8:
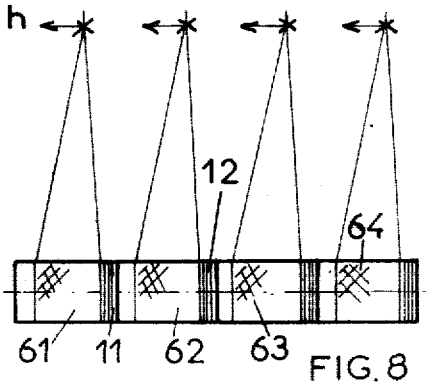

The winding frame according to FIGS. 1 and 2 includes spindle 1 on which is mounted, for example, four reel support tubes 21,22, 23, 24, pilot roller 3 (shown only in FIG. 1), device 4 for reciprocating distribution of yarns, and a reciprocating yarn guide 41,42,43 or 44 for each reel attached to device 4. Pilot roller 3, is in tangential contact with tubes 21, 22, 23, 24; then, after winding has begun, to form yarn reels or packages 61, 62, 63, 64 (represented by dotted lines), pilot roller 3 has the function of controlling the peripheral speed of the reels by supplying all or part of the torque necessary for their driving. Separate drive means can also be associated with spindle 1 in place of or in combination with pilot roller 3. The reciprocating yarn distribution device 4 includes four reciprocating yarn guides 41, 42, 43, 44, respectively for yarns Y1, Y2, Y3, Y4 which form reels 61, 62, 63, 64 respectively. For each reel, there is a positioning guide 51, 52, 53, 54, placed upstream from the corresponding reciprocating guide. In normal operation, the positioning guide is stationary and located midway to the perpendicular of the segment representing the travel of the reciprocating guide as shown in FIG. 2.

The winding frame includes guide ramp 7 for the yarns to be wound, extending along the zone traversed by the reciprocating guides. The ramp is capable of occupying at least two positions: a "withdrawn" position (OFF) in which it is inoperative and an "active " position (ON). In the "ON" position, the ramp comes in contact with the yarns on the section going from the positioning guides to spindle 1 and modifies the travel of the yarns so that they are disengaged from their respective reciprocating guides. Passage from the "ON" position to the "OFF" position has the effect of removing the yarns from the action of the ramp and causing them to be taken over by their respective reciprocating guides. Passage from the "OFF" position to the "ON" position has the effect of taking the yarns out of their respective reciprocating guides.

In FIGS. 1 and 2, the ramp 7 includes pivotable straight rod 5, with a curved end 6 to promote placement of the yarns. Struts 13 and 14 pivotally connect rod 5 to the reciprocating distribution bar 4. In these figures, the ramp is shown by solid lines in its "OFF" position and by dotted lines, in its "ON" position (in FIG. 1).

Sliding rod 16 carries positioning guides 51–54. The temporary holding pin in its retractable form is shown at 8. Sliding movement of rod 16 is achieved by crank-connecting rod system shown in FIG. 10 and will be described below.

The phases of the winding process, after the rotation of pilot roller and spindle and the movement of reciprocating device are started, including the formation of a transfer end, are illustrated in FIGS. 3 to 8:

Phase 1—Hooking (FIG. 3)—Ramp 7 is placed in its "ON" position, and positioning guides 51–54 are in the position corresponding to the midpoint of the main winding zone for each yarn. The four yarns are handled together by driving nozzle 9. Nozzle 9 is placed in hooking position: in this position, the four yarns Y1 to Y4 rest on the rod 5 of guide ramp 7 and on pin 8. The pin is then retracted, thus modifying the path of the four yarns which then come in contact with the end of tube 24 which is provided with one or more hooking slots (not shown). The four yarns are hooked approximately simultaneously at the end of tube 24. Winding of the yarns begins.

Phase 2—Positioning of the yarns on their winding zones (FIG. 4)—Under the influence of recall forces, the yarns slide along the rod 5. Each yarn tends to follow the shortest route between its positioning guide and spindle and therefore moves in a direction perpendicular to the axis of the spindle; it is therefore wound on the spindle at the level of its associated positioning guide.

Phase 3—Normal reciprocating winding (FIG. 5)—Ramp 7 is moved to its OFF position out of contact with yarns 4. Yarns 4 are taken up by their respective reciprocating guides. A winding beginning is formed in each of the main winding zones.

Phase 4—Movement of the positioning guides to the level of the attachment zone (arrow g, FIG. 6)—Ramp 7 may be kept in the OFF position, or may be placed in its ON position. The ON position is used to disengage the yarns from the action of the reciprocating guides, when changes in the tension of the yarn due to hitting of the guides run the risk of having harmful effects on the yarn or performance of the process (for example: breaks and deterioration on the delivery rollers placed upstream).

Phase 5—Formation of the transfer end (FIG. 7)—Positioning guides 51 to 54 having reached a position corresponding to a level over the attachment zone, the guide ramp is put in ON position, if this has not already been done, to apply the force required to disengage the yarns from the reciprocating guides. Each of the yarns is wound on its respective support tube, at the height of the positioning guide, forming a transfer end (11, 12, etc.)

Phase 6—Formation of the main winding (FIG. 8)—Ramp 7 is moved to the OFF position, then, when the attachment is completed, the positioning guides return to the middle position (arrow h). The four yarns again engage the reciprocating guides so that the main winding (61, 62, 63, 64) may begin.

Phase 2 of the process, at the end of which the yarn is immobile in translation, should be as short as possible, to avoid the formation of rims such as shown at 15 (FIG. 4) which would be bothersome for making a uniform winding. The interval between hooking of the yarns and withdrawal of ramp 7 should correspond as close as possible to the time necessary for the yarns to go from phase 1 to the end of phase 2. Retraction of pin 8 (which triggers hooking) and withdrawal of ramp 7 (which triggers grabbing of the yarns by the reciprocating guides) are strictly synchronized. For present winding speeds (3000 to 6000 meters/minute), the time interval between these two operations is some tenths of a second.

As already pointed out, holding pin 8, in another embodiment, is stationary, and the movement of ramp 7 going from "OFF" position to "ON" position causes the escape of the yarns from the temporary holding pin and their attachment (hooking to the end tube support 24). In this case, it is necessary to synchronize the movement of the ramp from the "OFF" position to the "ON" position (beginning of phase 1) with the movement of the ramp from the "ON" position to the "OFF" position (beginning of phase 3). Such an embodiment, with a stationary pin, is shown in FIGS. 11, 12 and 13.

Figure 11:
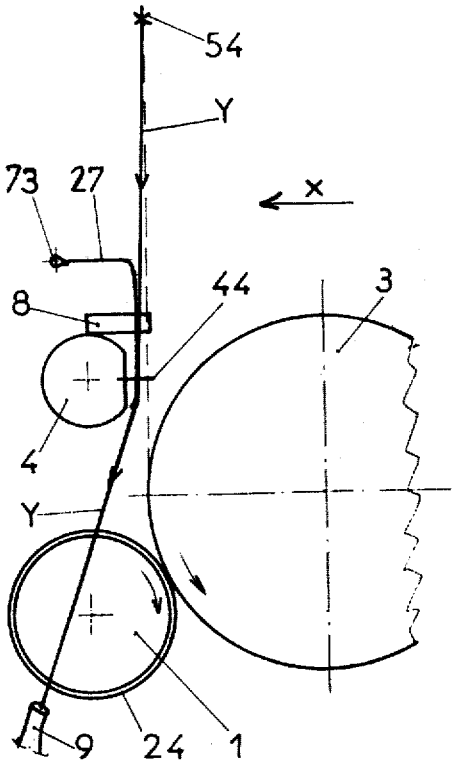
FIGS. 11 and 12 are schematic end views of a winding frame equipped with a second embodiment of a device according to the invention.
Figure 12:
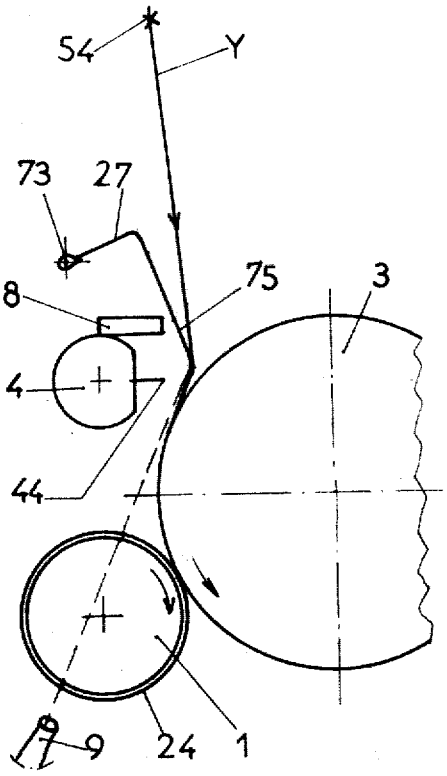
Figure 13:
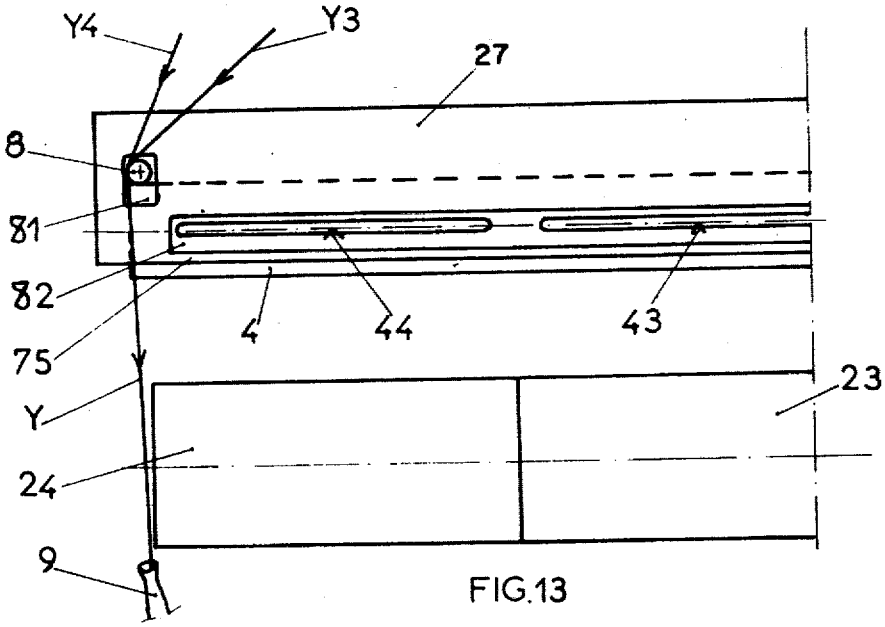
FIG. 13 is a partial view in the direction of arrow X of FIG. 11.

A winding frame similar to that of FIGS. 1 and 2 is shown in FIGS. 11 and 12 and FIG. 13 in which the same reference numerals designate the same elements as in FIGS. 1 and 2. The guide ramp is made by pivoting plate 27 provided with a guiding edge 75, articulated around a shaft 73 parallel to the axis of spindle 1. The guide ramp is shown in "OFF" position in FIG. 11 and "ON" position in FIG. 12. Yarn holding pin 8 is stationary and integral with the body of reciprocating distribution device 4. Plate 27 is provided with two holes 81 and 82. When the plate is in the "OFF" position (FIG. 11), pin 8 goes through hole 81 and reciprocating guides 41 to 44 go through hole 82, which extends approximately over the entire length of plate 27. Before attaching to the spindle by hooking, the yarns follow the path shown (FIGS. 11 and 13), by resting both on plate 27 and pin 8. To perform hooking, plate 27 is made to pivot from "OFF" position (FIG. 11) to "ON" position (FIG. 12). This pivoting movement thrusts the yarns toward the end of pin 8. The yarns disengage from the pin; there is a hooking on tube 24 and the beginning of the winding (phase 1); the yarns then slide over the guide edge 75 and come to be positioned at right angles to their respective positioning guides (phase 2).

Additional steps and corresponding means forming a part of the invention are provided to assure the reliable use of the process; they come into play during different phases as described below.

Figure 9:
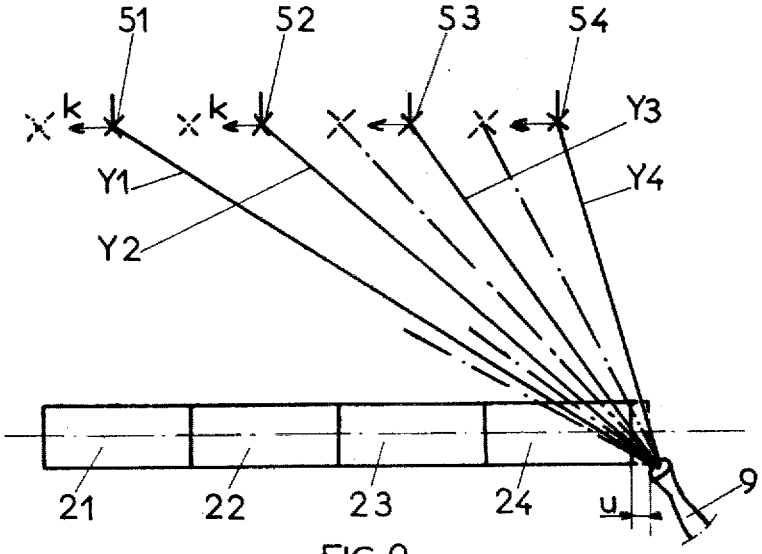

Phase 1—Hooking—Tubes 21 to 24, which are commercially available, have rather large fabrication tolerances. The length of four tubes put end to end (and a fortiori that of a greater number) can vary in rather large proportions, on the order of a half centimeter and more (length u, FIG. 9). If the hooking of the yarns is performed by an automatic device (for example, the hooking head of an automatic holder), the hooking position of nozzle 9 is determined as a function of the end of spindle 1 and it is stationary. On the other hand, since the position of the end of the tube 24 can vary widely, it can happen that the last yarn Y4, the least deviated, cannot come in contact with the end of tube 24 when nozzle 9 occupies the hooking position (FIG. 9). It will then not be hooked. To remedy this drawback, according to the invention, before hooking, positioning guides 51 to 54 are moved from the middle point in the direction opposite the hooking point (arrow K, FIG. 9). Thus, the deviation of the yarn paths is increased so that, considering the geometry of the winding frame, hooking of all the yarns is definitely assured (FIG. 9, broken lines). The above movement is advantageously performed by the crank-connecting rod system shown in FIG. 10 and which also assures the movement of rod 16 and the positioning guides to the attachment zone.

Phase 5—Formation of the transfer end—The transfer end is the result of the movement of the rod 16 and the positioning guides caused by a crank-connecting rod system. Since the transfer end is made at the end of the travel, the moving speed is slight and there is a risk of having a tail (end) made up of too large a winding, which is hard to use. To overcome this drawback, the moving speed of the positioning guides is increased in the attachment zone by incorporating a piston, jack or other similar device to the crank-connecting rod system. The jack is actuated at the end of travel of the rod, such that the two movements of the rod and jack are added together, increasing the moving speed of the positioning guides and the pitch of the coil of the attachment winding.

Figure 10:
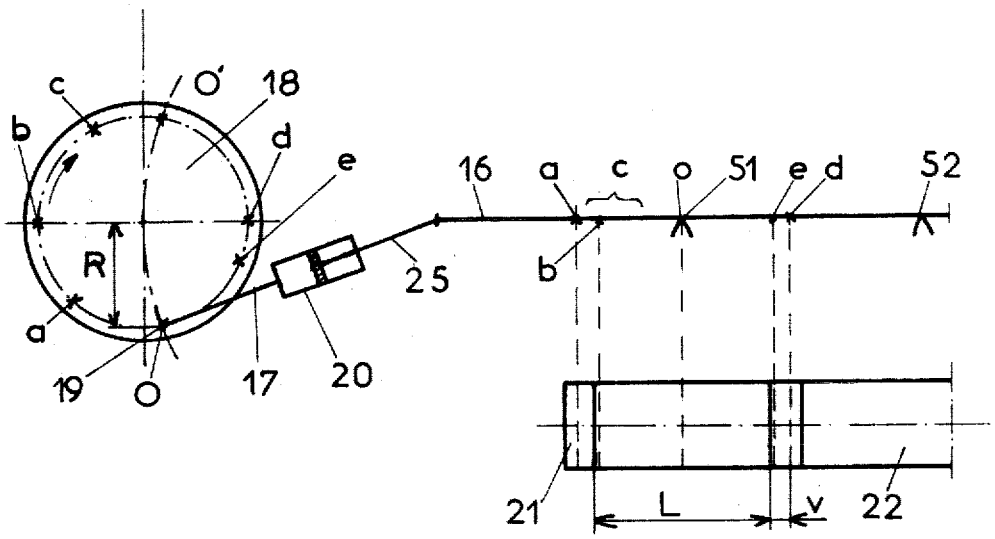
FIG. 10 is a partial schematic view of an embodiment of a crank-connecting rod system according to the invention.

The crank-connecting rod system for driving rod 16 is shown in FIG. 10. Rod 16 is shown carrying positioning guides of which only two are shown (51, 52). Rod 16 is connected by rod 17 to a circular rotating plate 18. Rod 17 is made up in part of a jack 20 with fluid drive means from a source not shown. When the jack is immobilized, the system acts like a standard crank-connecting rod system. When the jack is fed, the movement of rod 25 of the jack is added to the movement resulting from the rotation of plate 18 thus increasing the speed of movement of rod 16 and the positioning guides. Plate 18 can be driven in rotation, for example, by a reducer unit. Rotation of plate 18 also controls the passage of ramp 7 from one of its two positions to the other and the retraction of pin 8 and feeding of jack 20. The controls can be performed by contactors triggered by cams placed on the periphery of plate 18 or on the periphery of discs connected in rotation with plate 18.

Rotation of plate 18 can be triggered by a signal emitted by an electronic program of storing and winding that are entirely automated, as described for example in French Pat. No. 2,267,272 and application for certificate of addition published under French Pat. No. 2,282,392 both commonly assigned with the subject application and incorporated herein by reference. Segment L, carried on tube 21, represents the zone of main winding, segment v the attachment zone. When the crosshead 19 is in position O and O', the positioning guides are in the middle-position, on the semiperpendicular of segment L.

For using the process with a retractable pin and ramp in the position "OFF" during phase 4, letters a, b, c, d, e, represent the following positions:

a: point of retraction of pin 8, i.e., hooking, b: extreme point reached by positioning guides opposite the attachment, c: point of putting ramp 7 in "OFF" position, d: point of putting ramp 7 in "ON"position which can be located at the limit to the end point of the travel of the positioning guides, e: point of putting ramp 7 in "OFF" position.

It can be seen that the performance of the hooking process with the formation of the transfer end corresponds exactly to one rotation of plate 18, the transfer end being made between d and e.

Figure 14:
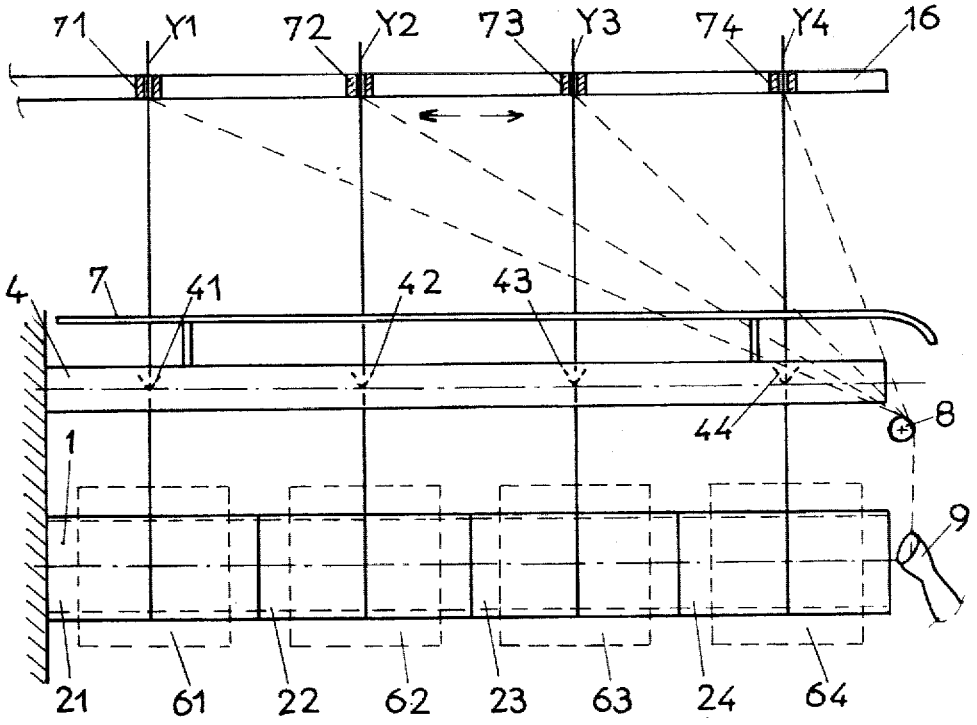
FIG. 14 is similar to the winding frame according to FIG. 2 but equipped with intertwining nozzles.
Figure 15:
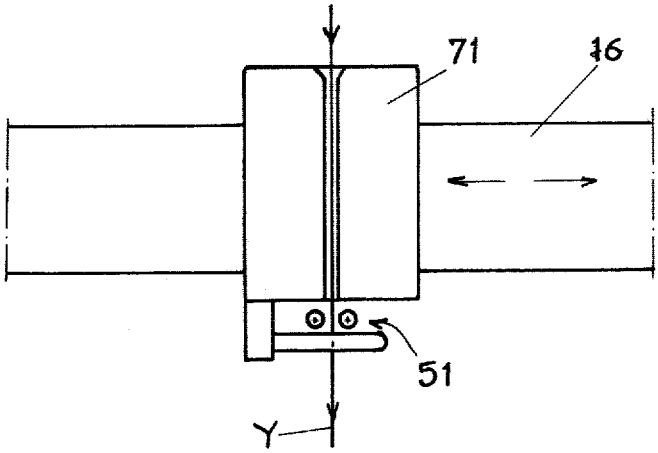
FIG. 15 is a schematic side view of an intertwining nozzle and the corresponding positioning guide.

FIGS. 14 and 15 show embodiments according to which intertwining nozzles are provided at the site on the positioning guides on movable means for mounting the guides. These intertwining nozzles are useful, particularly, during the phase of forming the transfer end.

FIG. 14 is similar to FIG. 2 with, as modification, the replacement of positioning guides 51, 52, 53, 54 by intertwining nozzles 71, 72, 73, 74 placed at the same sites on the sliding rod 16.

FIG. 15 represents a nozzle unit 71 plus positioning guide 51, connected with sliding rod 16. The guide placed at the outlet of nozzle 71 is made up in a known way of two pairs of parallel pins, one pair placed perpendicular to the other. Nozzle 71 is of any known type supplied with an air jet from a suitable source (not shown). When an intertwining is made during formation of the transfer end, phase 5 of the winding process previously described further comprises starting nozzles 71 to 74, then, stopping the nozzles when the transfer end is finished.

The embodiment according to which nozzles are placed approximately at the sites of the positioning guides, on mobile means for mounting the guides, has several advantages.

In the case of winding after spinning, the nozzles are placed at the winding stage: lower stage and not the spinning stage: higher stage. Consequently there results: good accessibility of the nozzles from the winding stage; and a simplification of the depositing of the yarn at the spinning stage.

Actually, most often, in particular when a partially drawn yarn is produced, handling of the yarns, at the spinning stage, is done manually, without the aid of a handling gun. But passage of the yarn into the nozzle requires the use of a gun. The nozzles being at the winding stage, the gun is used which is already used at this stage for throwing and thus avoids the use of a second gun at the spinning stage.

Other advantages of the use of the interwining nozzles include a relatively large distance between the nozzle and oiling device currently placed at the spinning stage. This distance is beneficial for the following reasons:

when the yarn arrives in the nozzle, the oil has had time to migrate to the inside of the yarn, consequently a more constant rate of oiling is achieved, and vibrations of the yarn caused by intertwining are no longer notable at the level of the device for applying the oil. They therefore no longer affect the regularity of the deposit and, on the other hand, do not cause exuding of the oil, both causes of stains.

The nozzles being placed on the movable mounting means for the positioning guides, unnecessary tensionings are avoided therefore reducing the risks of harmful increase of tension. These risks would occur particularly when the positioning guides are in the attachment position, if the nozzles were stationary, not connected with the guides.

Obviously, the winding apparatus of the invention, is not limited to the embodiment described, but can comprise many variants. Thus, the passage of ramp 7 from one of its positions to the other, in addition to pivoting, can be performed by translation or by a combination of movements. Also, movement of the positioning guides can be performed by a system made up of jacks acting in two directions of movement, or by a system of motorized screw and sliding nut or by any other suitable means.

The invention offers a great flexibility, being easy to adapt to the number of windings it is desired to perform on the same spindle. Thus, to go from two long windings to four short windings, on the same spindle, it suffices, on the one hand, to move the point of attachment of rod 17 on plate 18 so as to reduce the crank radius R and, on the other hand, to move positioning guides on rod 16 and if necessary add additional guides.

The invention is applicable to winding of textile yarns of any type or count which are able to be delivered continuously at high speed (3,000 to 6,000 meters/minute and more). It is applicable to processes of winding of chemical yarns, entirely automated, with bobbin-changing performed automatically.

What is claimed is:

1. In a process for simultaneously winding each of several yarns into separate yarn reels on yarn support tubes carried on the same spindle by bringing the yarns, each traveling in a distinct path, through a positioning guide and a reciprocating distribution guide for winding each yarn in a main winding zone on an associated yarn support tube as each yarn support tube is rotated, the improvement which comprises, passing each yarn through its respective positioning guide;

attaching each yarn, substantially simultaneously, to an end of the spindle;

applying a force to each yarn to put each yarn out of contact with its respective reciprocating distribution guide, each yarn moving in a direction substantially parallel to the axis of the spindle under the influence of recall forces, thereby allowing each yarn to position itself on its respective main winding zone on its respective yarn support tube at approximately right angles to its respective positioning guide;

removing the force applied to each yarn to thereby allow each yarn to change its path of travel in a direction to engage with its respective reciprocating distribution guide; and, forming a transfer end for each yarn in an attachment zone located on the yarn support tube adjacent to and outside of the main winding zone of each yarn reel by the steps of:

moving the positioning guide for each yarn to a position over the attachment zone of said yarn;

disengaging each of the yarns from its respective reciprocating distribution guide by applying a force to each of the yarns in a direction substantially perpendicular to the axis of the spindle and away from said guides;

forming a transfer end in each attachment zone at a position substantially directly below the respective positioning guides; and withdrawing the force applied to each of the yarns and returning each positioning guide to a position above its associated main winding zone.

2. The process of claim 1 wherein each positioning guide is moved to its position over the associated attachment zone before each of the yarns are disengaged from its reciprocating distribution guide.

3. The process of claim 1 wherein each of the yarns are disengaged from their respective reciprocating distribution guides before the positioning guides are moved to their position over the attachment zones.

4. An apparatus for simultaneously forming several yarn packages or yarn reels on yarn support tubes from an equal number of yarns travelling in a distinct path, each yarn reel comprising a main winding zone and an optional transfer end in an attachment zone located outside of the main winding zone which comprises a winding frame;

a spindle attached to the winding frame, one end of said spindle including yarn attachment means associated therewith;

each yarn support tube carried on said spindle, each tube being rotatable about the axis of said spindle;

means for rotatably driving each of said yarn support tubes;

a positioning guide for each of the several yarns, each positioning guide being movable from a normal position about midway over a respective main winding zone to a position over a respective attachment zone;

a reciprocating distributing guide for each yarn located between the positioning guides and the spindle;

a guide ramp extending at least across the path traversed by the reciprocating distribution guides, said ramp being adapted to move from an "active" position in contact with the yarns to apply sufficient force to the yarns to disengage the yarns from the reciprocating distribution guides to an "inoperative" position in which it is out of contact with the yarns, each yarn being engaged with its associated reciprocating distribution guide when the guide ramp is in the inoperative position; and, a temporary yarn holding pin located adjacent to the end of the spindle having the yarn attachment means associated therewith and in close proximity to said yarn attachment means.

5. The winding apparatus according to claim 4 wherein the yarn holding pin is retractable to a position out of contact with said yarns.

6. The winding apparatus according to claim 4 wherein the yarn holding pin is located in the path of travel of the guide ramp from the active position to the inoperative position, the yarns being in contact with the holding pin when the guide ramp is in the inoperative position and the yarns being taken out of contact with the holding pin when the guide ramp is in the operative position.

7. The winding apparatus according to any one of claims 4, 5 or 6 which further comprises means for forming a transfer end in each said attachment zone, said means comprising means for moving a respective positioning guide between a position over the respective main winding zone to a position over the respective attachment zone and means for driving, controlling and synchronizing the relative movements of the guide ramp and each of the positioning guides.

8. The apparatus according to claim 7 wherein the means for driving, controlling and synchronizing the movements of the guide ramp and positioning guides also controls the movement of the temporary yarn holding pin.

9. The apparatus according to claim 7 which further comprises means for reciprocatingly moving in translation each of the positioning guides in unison in a direction approximately parallel to the axis of the spindle and for a distance approximately equal to the length of a yarn support tube.

10. The apparatus of claim 9 wherein said moving means comprises a rod member to which each of said positioning guides are connected and a crank-connecting rod system connected to said rod member.

11. The apparatus of claim 10 wherein the crank-connecting rod system includes means for increasing the speed of movement of said rod member when the positioning guides are positioned over the respective attachment zones.

12. The apparatus of claim 11 wherein said accelerating means includes a fluid driven jack.

13. The apparatus according to claim 7 which further comprises at least one yarn intertwining nozzle associated with said moving means, each intertwining nozzle being located on the moving means at a position corresponding to the position of a positioning guide.

14. The apparatus according the claim 13 wherein each intertwining nozzle is located upstream from and adjacent to a positioning guide.

15. The apparatus according to claim 13 wherein the intertwining nozzles function as said positioning guides.

16. The apparatus of claim 13 in which there is one intertwining nozzle for each yarn to be wound.

* * * * *